US007802935B2

(12) United States Patent
Hilpert

(10) Patent No.: US 7,802,935 B2
(45) Date of Patent: Sep. 28, 2010

(54) PRINTING TABLE FOR A FLATBED PRINTING MACHINE

(75) Inventor: Markus Hilpert, Gundelfingen (DE)

(73) Assignee: Agfa Graphics NV, Mortsel (BE)

( * ) Notice: Subject to any disclaimer, the term of this patent is extended or adjusted under 35 U.S.C. 154(b) by 831 days.

(21) Appl. No.: 11/440,025

(22) Filed: May 25, 2006

(65) Prior Publication Data

US 2006/0280543 A1 Dec. 14, 2006

Related U.S. Application Data

(60) Provisional application No. 60/685,021, filed on May 27, 2005.

(30) Foreign Application Priority Data

May 25, 2005 (EP) ..... 05011311

(51) Int. Cl.
*B41J 11/00* (2006.01)

(52) U.S. Cl. ..... 400/656; 400/23; 400/55

(58) Field of Classification Search ..... 400/55, 400/23, 48, 29, 41, 660.3, 648, 656, 58; 101/407.1; 24/439; 219/216; 403/496; 248/603, 602, 660, 396, 901; 52/DIG. 5
See application file for complete search history.

(56) References Cited

U.S. PATENT DOCUMENTS 3,631,796 A * 1/1972 Hastings ..... 101/126
4,157,802 A * 6/1979 May, Jr. ..... 428/116
4,479,435 A * 10/1984 Takeuchi et al. ..... 101/389.1
4,929,106 A * 5/1990 Buan et al. ..... 400/649
5,322,377 A * 6/1994 Asai ..... 400/55
5,816,724 A * 10/1998 Hada et al. ..... 400/656
5,874,979 A * 2/1999 Ohyama ..... 347/104
6,112,663 A * 9/2000 Ulrich et al. ..... 101/389.1
6,431,771 B2 * 8/2002 Nagai et al. ..... 400/56
6,561,641 B1 * 5/2003 DeFosse et al. ..... 347/104
6,736,065 B2 * 5/2004 Naniwa et al. ..... 101/415.1
6,736,501 B2 * 5/2004 Yamaguchi et al. ..... 347/104
7,008,128 B1 * 3/2006 Nakanishi ..... 400/578
7,416,296 B2 * 8/2008 Takeda et al. ..... 347/104
2002/0067401 A1 * 6/2002 Yraceburu et al. ..... 347/102

(Continued)

FOREIGN PATENT DOCUMENTS

DE 100 14 010 A1 10/2000

OTHER PUBLICATIONS

European Search Report dated Nov. 29, 2005.

*Primary Examiner*—Judy Nguyen
*Assistant Examiner*—David Banh
(74) *Attorney, Agent, or Firm*—Keating & Bennett, LLP

(57) ABSTRACT

A printing table for a flatbed printing machine, for example, a large format digital flatbed printing machine, has a printing table base and a printing table plate disposed on the printing table base. The printing table base is connected by several connecting elements to the printing table plate. The connecting elements permit movement of the printing table plate relative to the printing table base, in particular movement caused by thermal expansion, only in a direction parallel to the printing table surface and only proceeding from a certain area of the printing table plate, the area having a point or line form and being fixed relative to the printing table base.

18 Claims, 7 Drawing Sheets

U.S. PATENT DOCUMENTS

2006/0201349 A1* 9/2006 Roberts et al. ..... 101/35
2006/0210345 A1* 9/2006 Sanada et al. ..... 400/648
2006/0242916 A1* 11/2006 Simko et al. ..... 52/177
2008/0305969 A1* 12/2008 Dijksman et al. ..... 506/30

* cited by examiner

PRINTING TABLE FOR A FLATBED PRINTING MACHINE

CROSS REFERENCE TO RELATED APPLICATIONS

This application claims the benefit of priority under 35 U.S.C. §119(e) to U.S. Provisional Application No. 60/685,021, filed May 27, 2005, and claims the benefit of priority under 35 U.S.C. §119(a) to European Application No. 05 011 311.7, filed May 25, 2005, the entire disclosures of these applications are herein expressly incorporated by reference.

This application is also related to U.S. application Ser. No. 11/440,029, entitled "Printing Table for Flatbed Printers" and U.S. application Ser. No. 11/440,026, entitled "Flatbed Printing Machine", filed on even date herewith.

BACKGROUND AND SUMMARY OF THE INVENTION

The invention relates to a printing table for a flatbed printing machine with a printing table base and a printing table plate disposed on the printing table base, where the printing table base is connected by several connecting elements to the printing table plate.

In large-format printing machines, e.g., for a print format of up to approximately two by three meters, a deviation, even if only very slight, in the planarity of the printing table surface represents a serious problem, in particular in the case of digital flatbed printing machines. This is because, for example, in ink jet printers the ink jet heads must be guided at a constant distance of approximately one millimeter over the medium to be printed on, e.g., a paper sheet, in order to ensure good print quality. Printing table surfaces with only extremely low deviations in their planarity are thus required. With, for example, only local warming of the printing table plate the problem of thermal deformation of the printing table plate arises, which then, for example, causes arching in isolated areas.

With the invention, a printing table for a flatbed printing machine, in particular a digital flatbed printing machine, will be provided which meets the highest requirements with respect to the planarity of the printing table surface.

For this, according to the invention, a printing table for a flatbed printing machine with a printing table base and a printing table plate disposed on the printing table base are provided, where the printing table base is connected by several connecting elements to the printing table plate. The connecting elements permit movement of the printing table plate relative to the printing table base, in particular movement caused by thermal expansion, only in the direction parallel to the printing table surface and only proceeding from a certain area of the printing table plate. The area has the form of a point or line and is fixed relative to the printing table base.

By limiting movement of the printing table plate relative to the printing table base only in the direction parallel to the printing table plate surface, the printing table plate can also expand locally while nonetheless arching is not to be feared. Due to the fact that only expansion proceeding from an area fixed relative to the printing table base is possible, there is on the printing table plate at least one point which is fixed with respect to the printing table base, in which, for example, the origin of a coordinate system of the control of the flatbed printing machine can be set. This fixed point of the printing table plate does not necessarily have to be rigidly connected to the printing table base, or connected to it at all. Rather, the connecting elements can be disposed so that a thermal expansion of the printing table plate is only possible proceeding from an area having the form of a point of line. Through the printing table according to the invention, a high table planarity which is extremely important, in particular in digital printing machines, can be achieved.

In a refinement of the invention, the connecting elements for the application of holding forces in and opposite to a holding direction are provided and with respect to the forces and displacements in the direction perpendicular to the holding direction are formed so as to be essentially bendable or are mounted in such a manner that they can move.

The connecting elements are thus formed essentially as single-valued bearings. Examples of single-valued bearings are rocking supports or roller bearings, in which forces in and opposite to a holding direction can be transmitted, but in the direction perpendicular to the holding direction displacements are possible. Through the use of such connecting elements the danger of distorting stress is clearly reduced since holding forces in different directions are also applied by different connecting elements.

In a refinement of the invention, the connecting elements comprise first connecting elements whose holding direction runs in the direction perpendicular to the printing table surface and second connecting elements whose holding direction runs in the direction parallel to the printing table surface.

According to the invention, a separation of connecting elements for different holding directions is thus provided, whereby the danger of distorting stress and warping is reduced. In addition, a simple, and moreover adjustable, structure results. This is of great importance, in particular for a possible adjustment of the table planarity. The first connecting elements thus hold the printing table at a constant distance from the printing table base and thus are a primary cause for table planarity with extremely small deviations. The first connecting elements can, for example, be adjustable in order to be able to adjust table planarity. As single-valued bearings, the first connecting elements can hold the printing table plate but not against relative movements in the direction parallel to the printing table surface. For this, the second connecting elements are provided, whose holding direction runs in the direction parallel to the printing table surface. The second connecting elements can also apply only holding forces in and opposite to their holding direction so that a second connecting element can also suppress only movement in a single direction lying parallel to the printing table surface. Thus, several second connecting elements are provided whose holding directions do not coincide and are disposed so that a relative movement of the printing table plate and the printing table base in particular sections, in particular due to thermal expansion, is possible only proceeding from a certain area of the printing table plate, the area having the form of a point of line and being fixed relative to the printing table base.

In a refinement of the invention, the second connecting elements are disposed so that each second connecting element is assigned to one of several imaginary lines running in the direction parallel to the printing table surface. The lines run through the printing table plate's point-like area, which is fixed relative to the printing table base, where the holding direction of each second connecting element runs in the direction perpendicular to its respective assigned line.

In this way, an extension of the printing table plate is possible only in the direction along or parallel to the imaginary lines since the second connecting elements can apply holding forces in the direction perpendicular thereto. The second connecting elements can thereby be disposed so that an expansion of the printing table plate is possible only along lines running at different angles through an area of the print pressure plate so that this area is fixed even with thermal expansion of the printing table plate relative to the printing table base.

For example, the imaginary lines can proceed in the form of a ray from one point on the printing table plate. This point can be the center of the printing table plate but also, for example, a corner of the printing table plate. Alternatively to a point-like area, an area in the form of a line can be provided, e.g., a front face of the printing table plate. The holding directions of the second connecting elements would, in this case, then be oriented in a direction perpendicular to the imaginary lines which for their part are oriented in turn in the direction perpendicular to the area in the form of a line.

In a refinement of the invention, the point-like area which is fixed relative to the printing table base is in the center of the printing table plate and second connecting elements are disposed in all four quadrants of the printing table plate and oriented with their holding directions in a direction perpendicular to the imaginary lines which proceed from the center at least at an angle in the set whose elements are 0°, 45°, 90°, 135°, 180°, 225°, 270°, and 315°.

Through such a star-like arrangement of the imaginary lines and the corresponding arrangement of the second connecting elements, the center of the printing table plate remains fixed even with thermal expansion of the printing table plate relative to the printing table base, and can at the same time be the origin of the coordinate system of the flatbed printing machine. In other words, due to the special arrangement and formation of the second connecting elements, the printing table plate can only "grow," corresponding to a thermal expansion, out from its center in the form of a star. However, the center itself is always fixed relative to the printing table base, independently of the type and size of the thermal expansion.

In a refinement of the invention, the first connecting elements are formed as holding bolts, which are disposed in the direction perpendicular to the printing table surface. Advantageously, the holding bolts comprise at least one circumferential groove, and around the area of the circumferential groove, can be bent in the direction perpendicular to their longitudinal extension.

Providing holding bolts permits the realization of a single-valued bearing of the rocking support type, and opens at the same time the possibility of adjusting the printing table plate with respect to its planarity via a longitudinal displacement of the holding bolt. Expediently, several adjustable holding bolts are provided for this purpose, distributed over the surface of the printing table plate. An essentially bendable structure of the holding bolts can be achieved by two circumferential grooves on the holding bolts, where the grooves are at a distance from one another and have a depth, for example, in the range of one half of the radius of the holding bolt. In the area of the circumferential grooves, the holding bolts can thus be bent with little force so that, in case of a thermal expansion of the printing table plate, no significant distortion stress and, caused thereby, warpage of the printing table plate, are to be feared.

In a refinement of the invention, the second connecting elements are formed as holding clips, which are formed for the application of holding forces in the direction parallel to the printing table surface and parallel to their longitudinal extension, and which are formed to be essentially bendable in the direction perpendicular to their longitudinal extension with respect to relative movements of the printing table plate and printing table base.

Providing holding clips makes possible very flat connecting elements which can be disposed without difficulty between the printing table plate and printing table base. The holding clips can, for example, be formed as sheet metal parts, where, by corresponding structuring of the sheet metal blank, holding forces can only be transmitted in and opposite to the longitudinal direction of the holding clips. On the contrary, in the direction perpendicular to the longitudinal direction, the holding clips are deformed by very small forces, so small in fact that, in case of thermal expansion, no distortion stress and, caused thereby, warpage of the printing table plate are to be feared. This also applies for a deformation by turning about the longitudinal direction, the turning also requiring only slight torques. The holding clips formed as sheet metal blanks are structured, for example, in the manner of a leaf spring.

In a refinement of the invention, the holding clips are formed by freely cutting a cover plate of the printing table base and/or a cover plate of the printing table plate.

In this way, a very flat structure can be achieved and the holding clips need no additional space between the printing table base and the printing table plate. The holding clips can, for example, be cut out of the cover plate by such a laser and thus can be produced simply and highly precisely. By realizing the holding clips by means of a free cutting action in a cover plate, no separate components for the construction of the second connecting elements are required.

Further features and advantages of the invention follow from the claims and the following description of a preferred form of the embodiment of the invention in connection with the drawings.

DETAILED DESCRIPTION OF THE DRAWINGS

Figure 1:
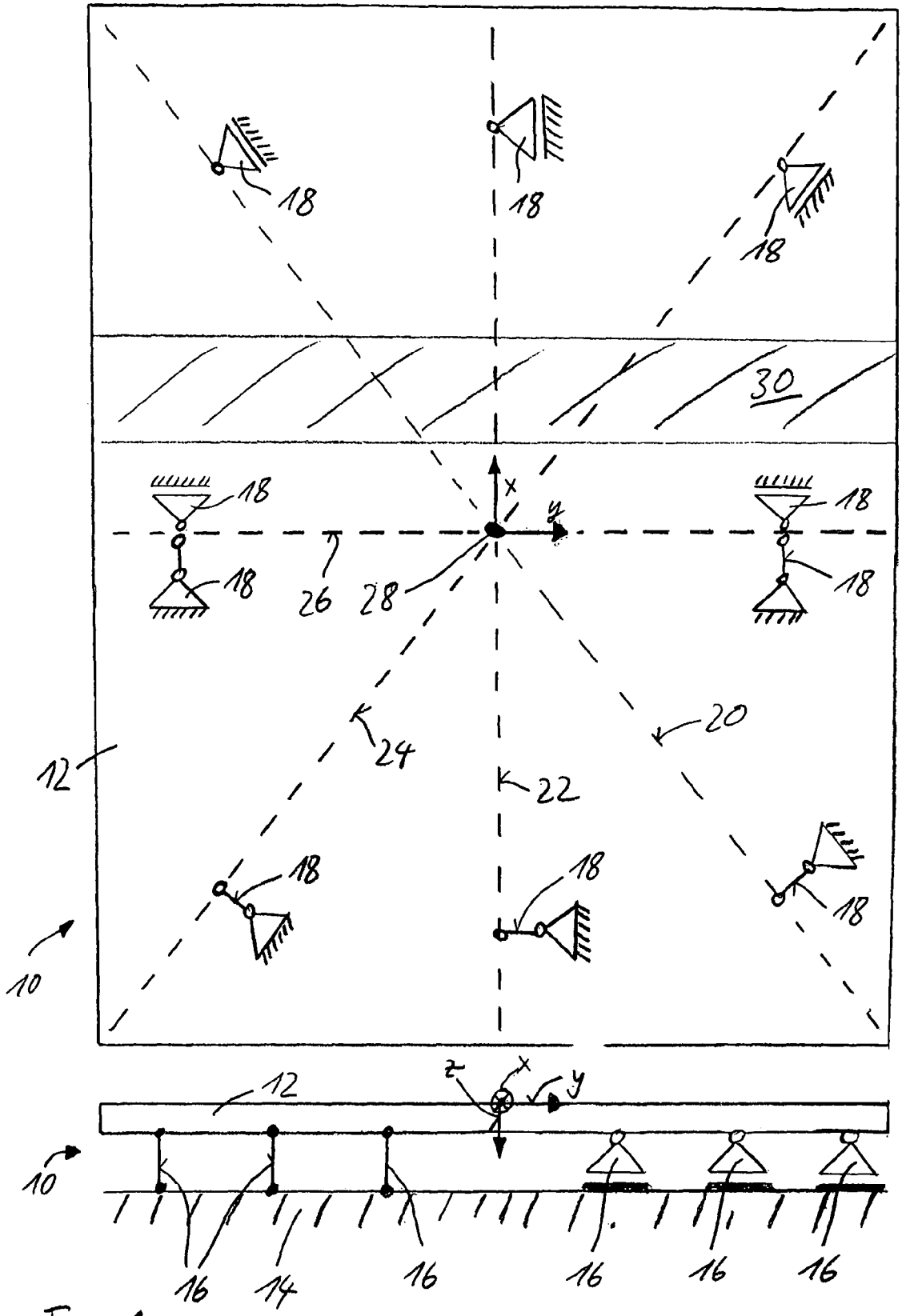
FIG. 1 is a schematic side view and a schematic plan view of a printing table according to the invention.

In the representation in FIG. 1, a schematic side view of a printing table 10 is shown in the lower area while in the upper area a schematic plan view of the printing table 10 is shown. The printing table 10 includes a printing table plate 12 and a printing table base 14, which are connected to one another by way of first connecting elements 16 and second connecting elements 18.

The first connecting elements 16 are only represented in the side view in FIG. 1 and, as rocking supports, in the left portion of the side view. In the right portion of the side view in FIG. 1, representation by means of the symbol for a single-valued (one-dimensional) bearing was chosen. It is essential that the first connecting elements 16 can apply only holding forces in the direction perpendicular to the printing table plate 12, and thus hold the printing table plate 12 at a constant distance above the printing table base 14. The first connecting elements 16 are formed so as to be flexible with respect to displacement, e.g., caused by thermal expansion, in the direction parallel to the printing table plate 12. This holds for displacements or expansions of the printing table plate 12 in two directions X and Y perpendicular to one another, as indicated with the aid of the coordinate system indicated in the side view and in the plan view. The connecting elements 16 can thus apply holding forces only in and opposite to their holding direction, namely in the direction perpendicular to the printing table plate 12 and corresponding to a z-direction, whereas displacements perpendicular thereto are possible.

In the plan view in FIG. 1, several second connecting elements 18 are shown, which also connect the printing table base 14 to the printing table plate 12. Here, the connecting elements 18 are represented in the lower portion of the plan view as rocking supports, while in the upper portion symbols for single-valued bearings were used.

The connecting elements 18 are formed and disposed so that they can apply only holding forces in and opposite to one holding direction, where the holding direction of all second connecting elements 18 is parallel to the printing table plate 12. The second connecting elements 18 allow displacements in the direction perpendicular thereto and thus in and opposite to the z-direction.

As is to be inferred from the plan view, the holding directions of the connecting elements 18 are each oriented in the direction perpendicular to imaginary lines 20, 22, 24 and 26, which are represented as dashed lines and which all run through the center 28 of the printing table plate 12. Starting from the center 28, the imaginary lines 20, 22, 24, 26 thus extend at angles of 0°, 45°, 90°, 135°, 180°, 225°, 270° and 315°. Overall, a star-like arrangement of the imaginary lines 20, 22, 24, 26 arises. The second connecting elements 18 are disposed so that they can each apply holding forces only in the direction perpendicular to the imaginary lines 20, 22, 24, 26. A thermal expansion of the printing table plate 12 is thus always only possible starting from the center 28, where the center 28 itself always remains fixed relative to the printing table base 14. The center 28 is thus not rigidly connected to the printing table base 14, since based on the special arrangement of the second connecting elements 18, a displacement of the center 28 relative to the printing table base 14 is not possible. This holds in other respects even with local heating and expansion of the printing table plate 12. If the printing table plate 12 were, for example, locally warmed in a strip-like area 30 indicated by cross-hatching, then a displacement of the center 28 opposite to the x-direction will be prevented by the second connecting elements 18, which are disposed so as to be perpendicular to the imaginary line 26. A displacement of the center 28 in or opposite to the y-direction will be prevented by the second connecting elements 18 which are disposed so as to be perpendicular to the imaginary line 24, by the connecting elements 18 whose holding direction is disposed so as to be perpendicular to the imaginary line 20, and by the second connecting elements 18 which are disposed so as to be perpendicular to the imaginary line 22. An expansion of the printing table plate 12 is thus only possible in the form of a ray proceeding from the center point 28. Even during such a thermal expansion, distorting stress and warping of the printing table plate 12 are avoided thereby.

Figure 2:
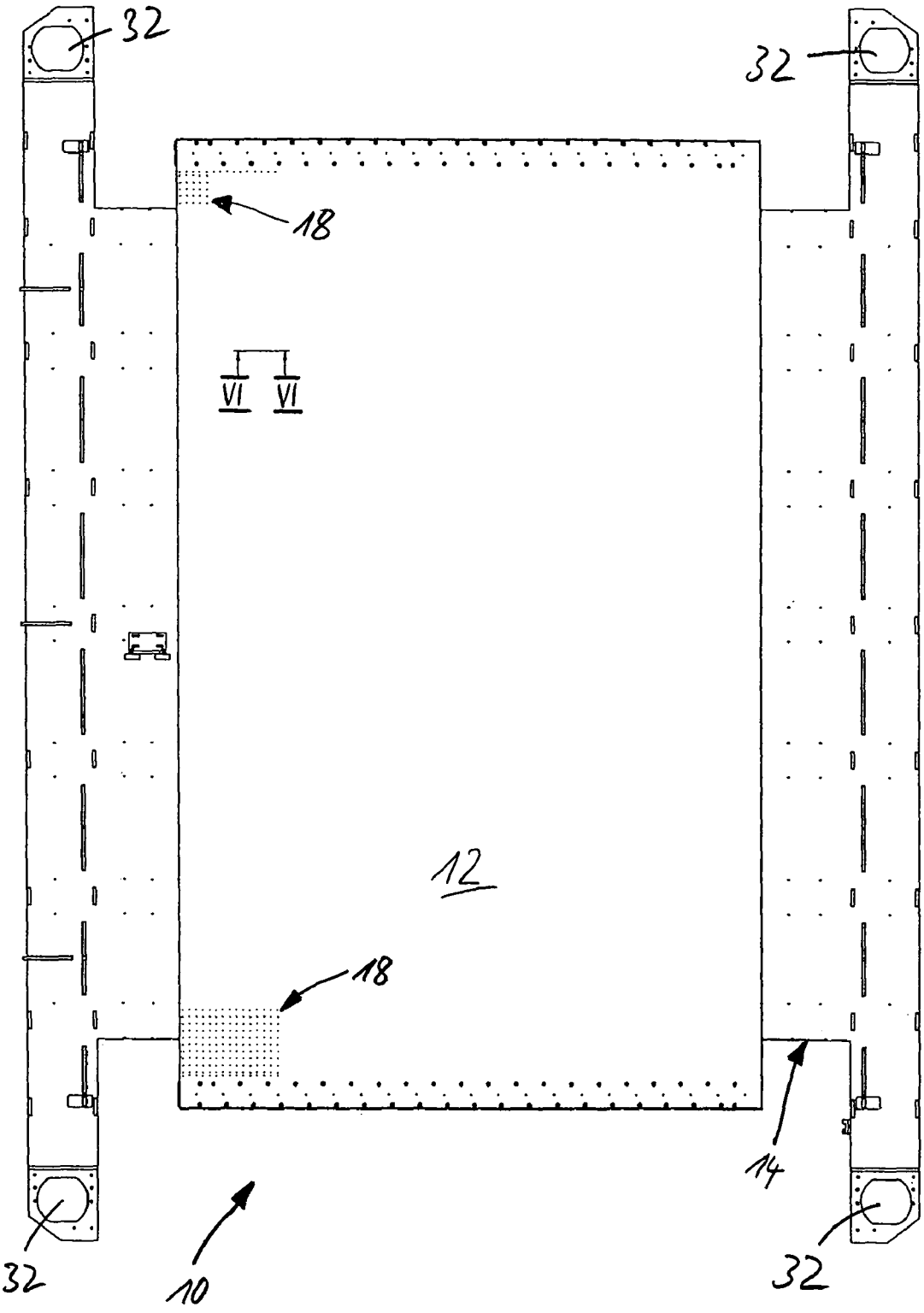
FIG. 2 is a plan view of a printing table according to the invention according to a preferred embodiment of the invention.

The plan view in FIG. 2 shows a preferred embodiment of the printing table 10. The printing table plate 12 and the printing table base 14 can be seen. The printing table base 14 has a generally H-shaped form and, at its four corners, through holes 32 are provided via which the printing table base 14 is connected to displacement elements not represented in order to enable raising and lowering of the entire printing table 10. The printing table plate 12 is provided with numerous vacuum holes 18, which are only partially represented in the representation in FIG. 2. To the vacuum holes 18, a vacuum can be applied in order to hold, securely and full-surface on the printing table surface, a paper sheet to be printed on.

Figure 3:
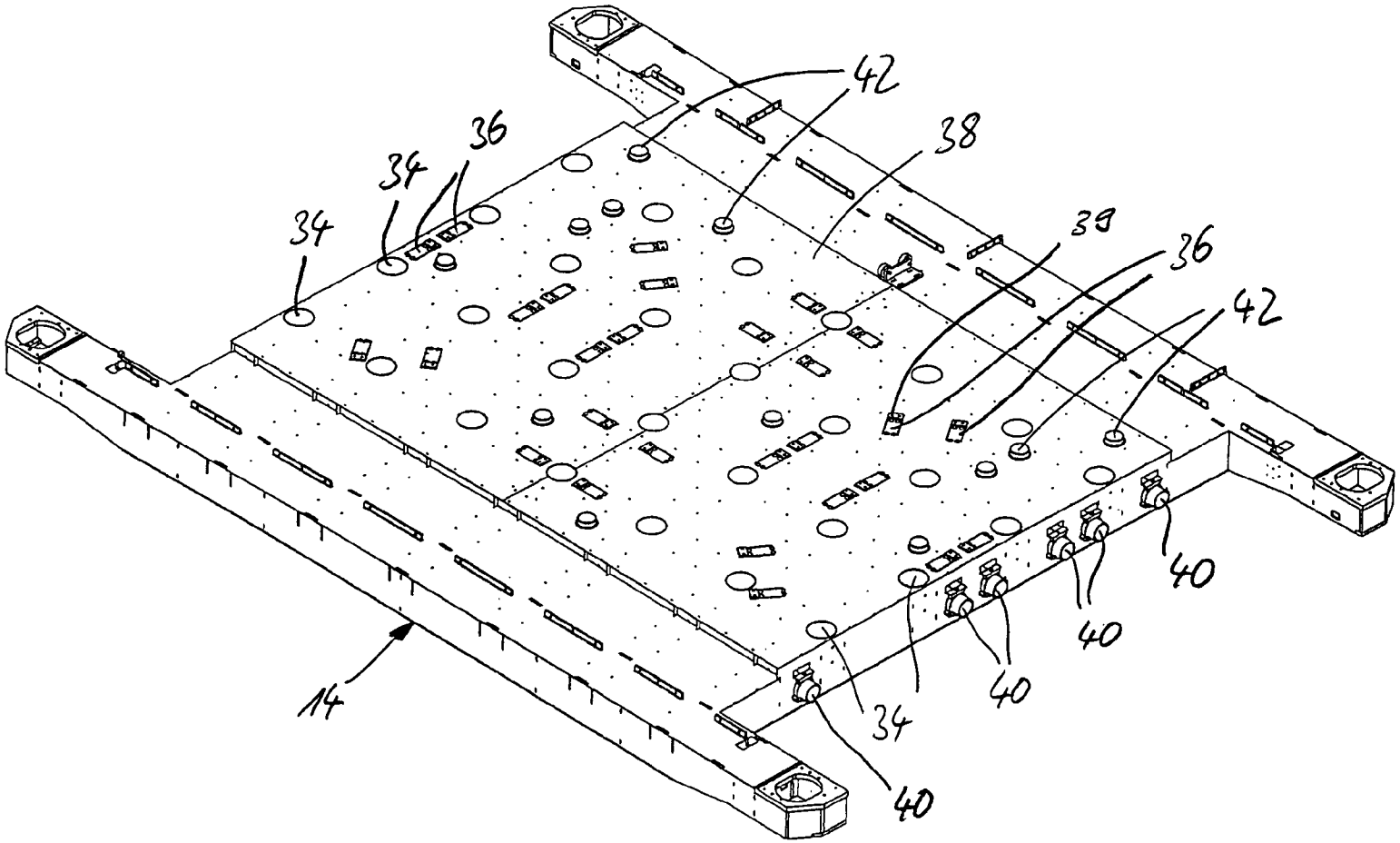
FIG. 3 is a perspective view of the printing table base in FIG. 2.

In the representation in FIG. 3, the printing table base 14 is represented in perspective view.

Figure 7:
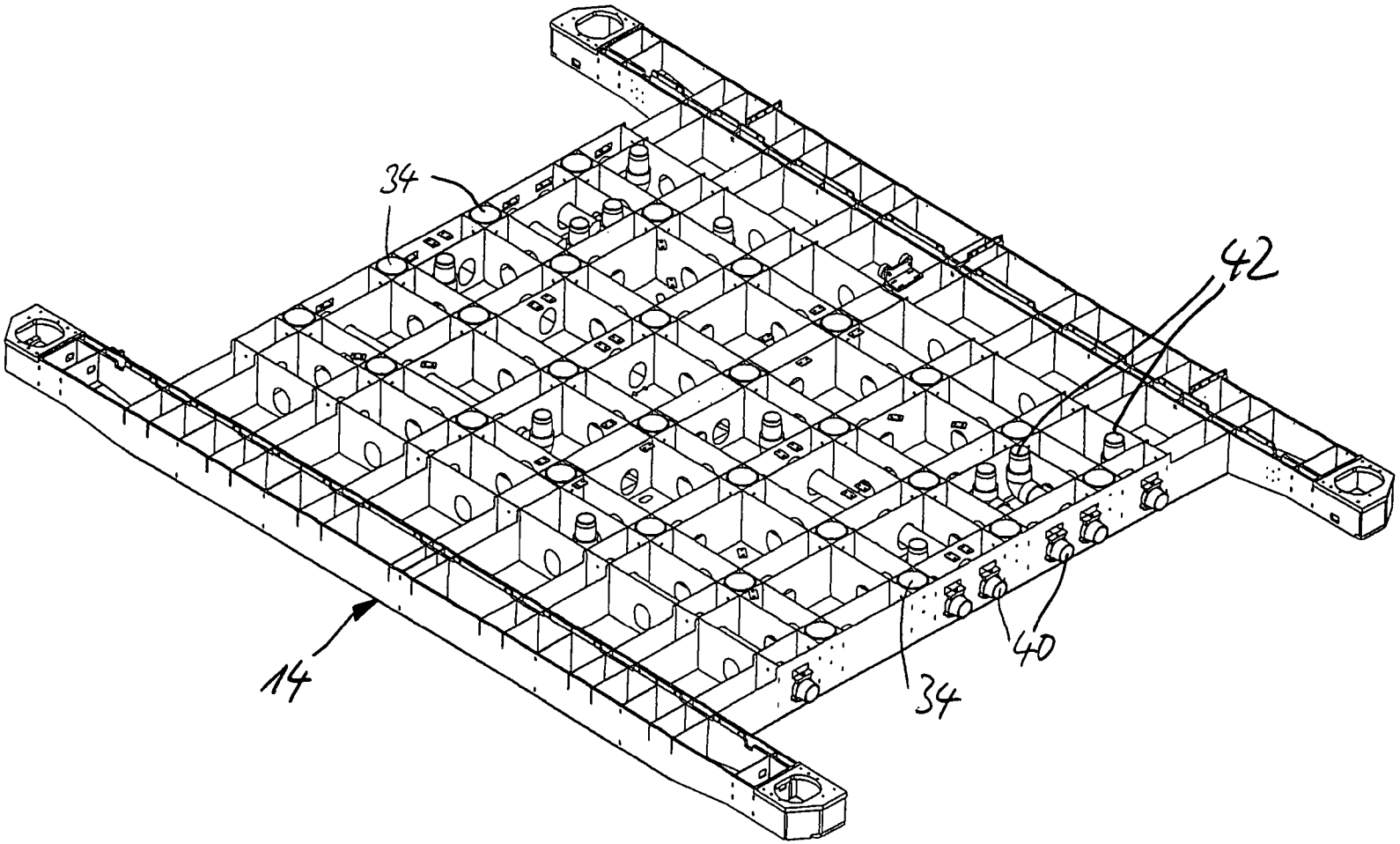
FIG. 7 is a perspective view of the printing table in FIGS. 3 and 4 with the cover plate removed.

FIG. 7 shows the corresponding view of the printing table base 14 with the cover plate removed.

The printing table base 14 includes openings 34 through which the first connecting elements, formed as holding bolts, can be inserted and connected to the printing table plate not represented in FIG. 3. The openings 34 are distributed uniformly over a surface of the printing table base 14, specifically that surface below the printing table plate, by means of tubular sections inserted into the printing table base 14, and in FIG. 3 represented only partially with the reference number 34. Therein, the holding bolts disposed in the openings 34 hold the printing table plate in a holding direction perpendicular to the printing table plate. A displacement parallel to the printing table plate is prevented by holding clips 36, which are formed in a cover plate of the printing table base 14. As is already to be seen with the aid of FIG. 3, the holding clips 36 are oriented in different directions corresponding to the arrangement already discussed with the aid of FIG. 1.

The holding clips 36 are designated only partially with the reference number 36. The holding clips 36 are formed as one piece with the cover plate 38 of the printing table base 14 and are cut out of the cover plate 38 by means of a free cutting action. At their movable end, the holding clips 36 each carry a mounting plate 39 with two through holes. By using screw bolts in these through holes, the printing table plate can then be connected to the printing table base 14.

Furthermore, the printing table base 14 includes several connections 40, which are provided for the application of a vacuum. The connections 40 are connected to connections 42 exiting from the cover plate 38, the connections then being in connection with corresponding vacuum channels in the printing table plate.

Figure 4:
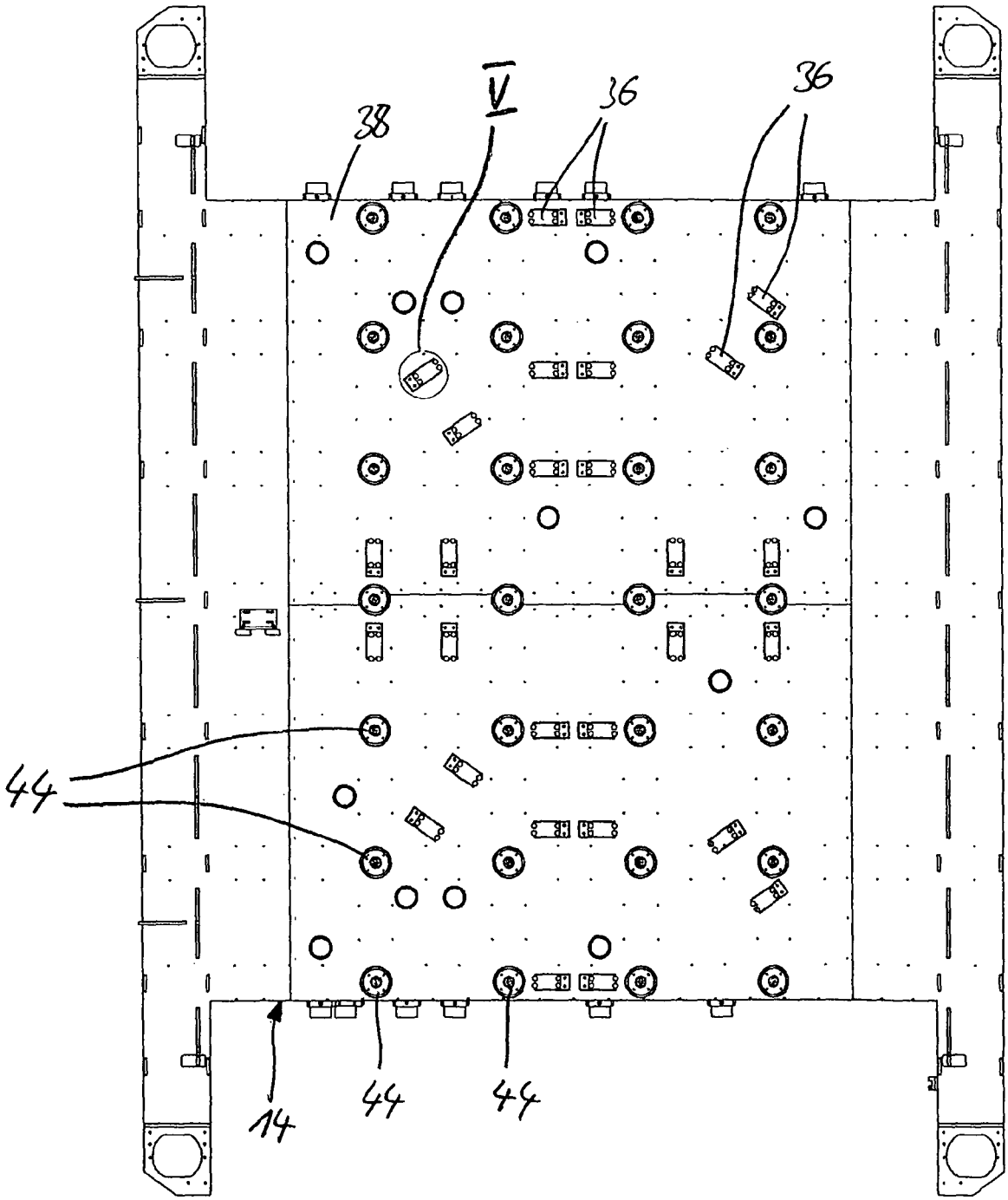
FIG. 4 is a plan view of the printing table base in FIG. 3.

The printing table base 14 in FIG. 3 is represented in a plan view in FIG. 4. In this plan view it is to be seen clearly that the holding clips 36 are placed corresponding to the arrangement already discussed with the aid of FIG. 1 so that the holding directions each run essentially perpendicular to the imaginary lines which intersect in the midpoint of the printing table plate. Corresponding to the arrangement in FIG. 1, the holding clips 36 are oriented so that their holding directions are perpendicular to the imaginary lines which go out from the center of the printing table plate at an angle of 0°, 45°, 90°, 135°, 180°, 225°, 270°, and 315°. As has already been explained with the aid of FIG. 1, it is ensured by this arrangement of the holding clips 36 that the printing table plate is connected to the printing table base 14 so that it can expand only in the form of a star and with its center fixed relative to the printing table base 14.

In the plan view in FIG. 4, one furthermore sees holding bolts 44 disposed in the openings 34 of the printing table base 14 and corresponding to the first connecting elements 16 in FIG. 1. These holding bolts 44 hold the printing table plate on the printing table base 14 and have a holding direction running in the direction perpendicular to the printing table plate.

Figure 5:
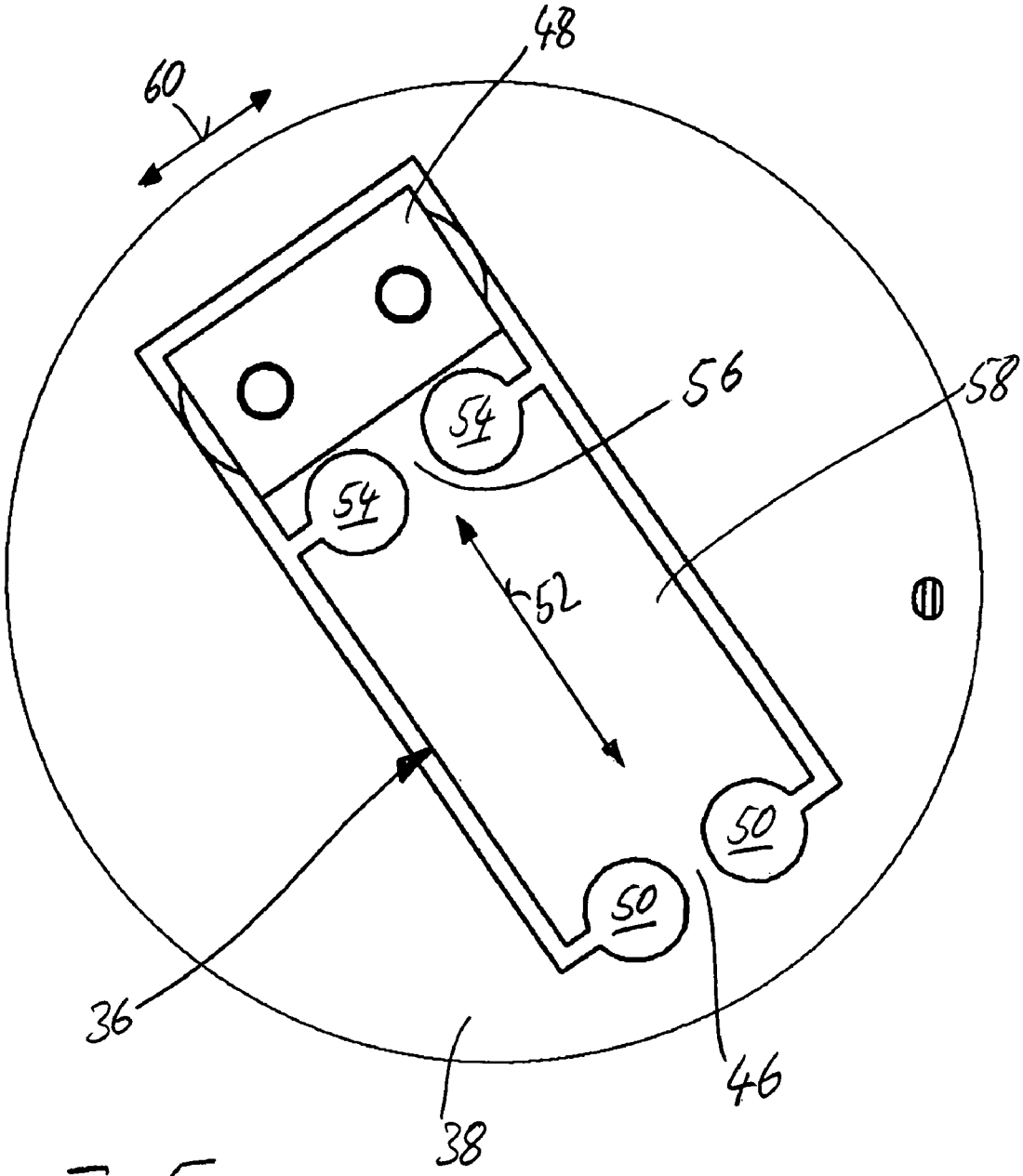
FIG. 5 is an enlarged representation of the detail V in FIG. 4.

FIG. 5 shows the detail V in FIG. 4 in an enlarged representation. It can be seen that the holding clips 36 are formed by a free cutting action in the cover plate 38 of the printing table base 14. The holding clips 36 are only connected by a narrow link 46 to the rest of the cover plate 38. At their end opposite the link 46, the holding clips 36 are provided with a mounting plate 48 via which the printing table 12 can be connected to the holding clip 36. The link 46 is formed by two circular sections 50, which leaves the link 46 standing between them. Proceeding from the circular sections 50, the cut extends a bit further in the direction perpendicular to the longitudinal direction of the holding clip 36, the longitudinal direction being indicated by means of a double arrow 52. In order to achieve the overall rectangular form of the holding clips 36, the cut then subsequently runs in the direction parallel to the longitudinal direction of the holding clip, and then at an end of the holding clip 36, specifically the end opposite the link 46, once again runs in the direction perpendicular to the longitudinal direction in order to cut out the holding clip 36.

In the area immediately in front of the mounting plate 48, an additional link 56 is formed by way of two additional circular sections 54 or holes, the link lying in alignment with the first link 46 with respect to the longitudinal direction 52. At one side of each of the circular sections 54, specifically the side opposite to the link 56, a short section running perpendicular to the longitudinal direction connects, said section running into the cuts defining the longitudinal edges of the holding clips 36. The area of the holding clip 36 at which the mounting plate 48 is fastened then connects to the link 56. Since circular sections 54 are connected to the section defining the outline of the holding clip 36, the mounting plate 48 is only connected to the central part 58 of the holding clip 36 via the link 56 and the central part 58 is then only connected to the cover plate 38 via the link 46.

As is already to be seen with the aid of the geometric structure of the holding clip 36, the holding clip 36 can thus only transfer appreciable holding forces in the directions of the double arrow 52 since it is formed so as to have a stable form in the directions of the double arrow 52. In the directions perpendicular thereto, especially in the directions of the double arrow 60, the holding clip 36 on the contrary permits movements of the mounting plate 48 relative to the cover plate 38 since there the links 46, 56 have a hinge-like action. With respect to movements in the directions of the double arrow 60, the holding clip 36 is thus essentially formed to be bendable. To the side of the mounting plate 48, sections in the form of a circular arc are to be seen which, however, in the mounted state are disposed above or below the plane of the cover plate 38 and thus do not prevent movement of the mounting plate 48 in the directions of the double arrow 60.

Overall, the holding clip 36 formed from a sheet metal blank is thus structured in the manner of a leaf spring. Moreover, due to its action in the manner of a leaf spring, the holding clip 36 is also movable in directions which run in the direction perpendicular to the cover plate 38. Movements in these directions are however, as already mentioned, prevented by the holding bolts 44 represented in FIG. 4. Movement of the mounting plate 48 in the direction perpendicular to the cover plate 38 is thus only required when the printing table plate is to be adjusted by means of the holding bolts 44.

Figure 6:
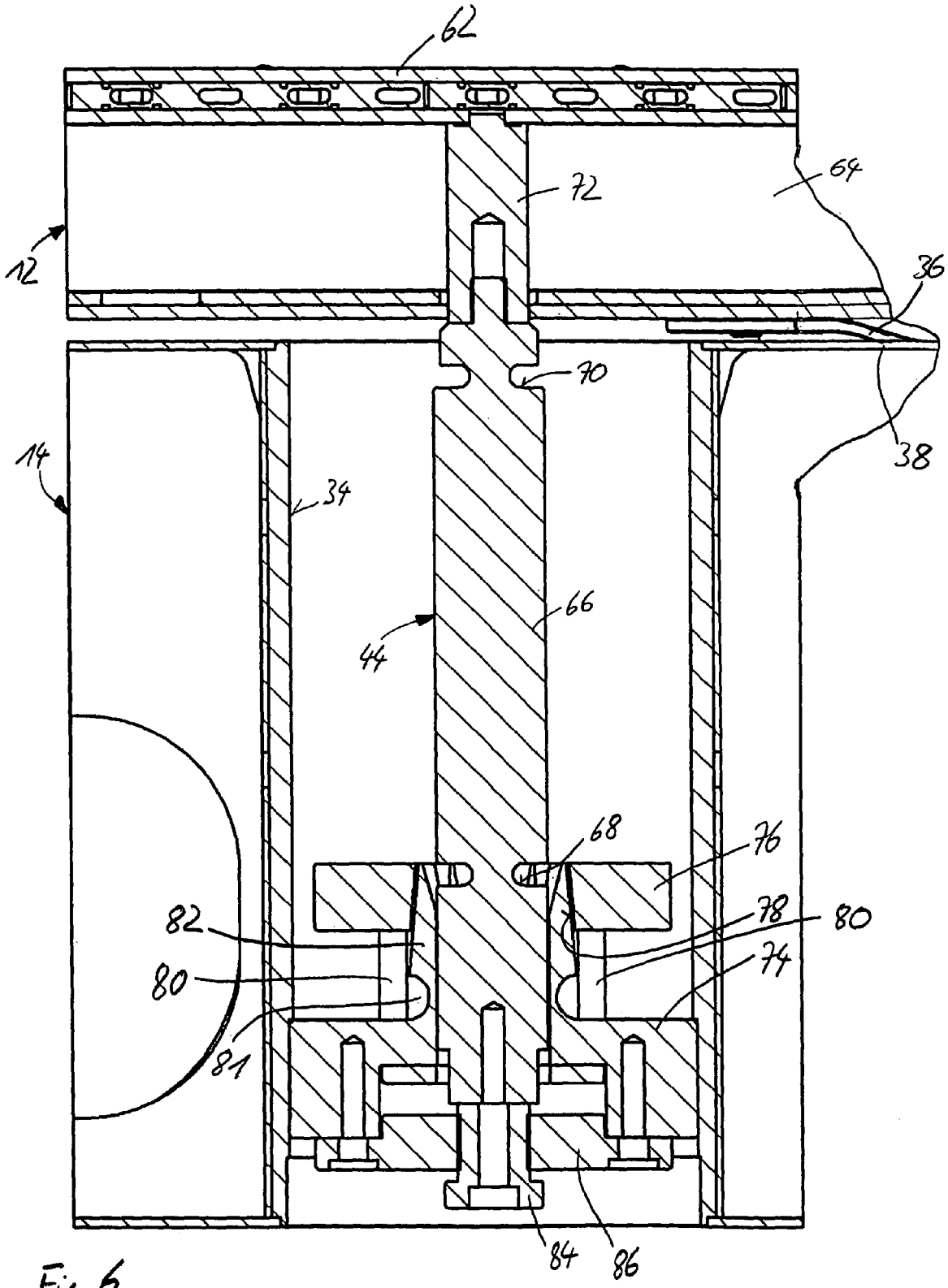
FIG. 6 is a view of the printing table in FIG. 2 sectioned in portions along the line VI-VI.

In the representation in FIG. 6, a view sectioned along the line VI-VI in FIG. 2 is shown. The sectioned view in FIG. 6 runs through an opening 34 in the printing table base 14 in which a holding bolt 44 is disposed. Also to be seen in FIG. 6 is a holding clip 36, which connects the printing table plate 12 to the cover plate 38 of the printing table base 14.

The printing table plate 12 itself has a cover plate 62 built up as a sandwich structure. The cover plate 62 comprises several extruded profiles disposed so as to be adjacent to one another and with channels formed therein for the flow of cooling water. On their upper and lower sides, the channels are connected with adhesive to other plates. This cover plate 62 is fastened to a substructure 64. The holding clips 36 connect the substructure 64 of the printing table plate 12 to the cover plate 38 of the printing table base 14. The holding bolts 44 include a bolt section 66 which is provided with two circumferential grooves 68 and 70 at a distance from one another in the longitudinal direction of the holding bolt. The circumferential grooves 68 and 70 penetrate the bolt section 66 up to approximately one half of its radius and, thereby, make possible bending of the bolt section 66 in the area of the circumferential grooves 68 and 70. The bolt sections 66 with the circumferential grooves 68, 70 act thereby in the manner of a hinge, and the material—as well as the dimensions of the bolt section 66 and the circumferential grooves 68, 70—are coordinated to one another so that bending forces which are required for bending the bolt section 66 in the direction perpendicular to its longitudinal direction cannot lead to an appreciable distortion stress of the printing table plate 12 which could then in turn cause warping of the cover plate 62.

Above the upper circumferential groove 70, the bolt section 66 is screwed, by way of a threaded section, into a tapped hole of a space holder 72, which is connected to the cover plate 62 and to the substructure 64 of the printing table plate 12. At its end opposite the printing table plate 12, the bolt section 66 is connected to a holding bushing 74, which in turn is secured by an adhesive in the opening 34 of the printing table base 14. The opening 34 is realized by way of a tubular section inserted into the printing table base 14.

The holding bushing 74 includes a clamping sleeve section 82 with a central through hole into which the bolt section 66 is inserted and within which the bolt section 66 can be displaced along its longitudinal direction. This displacing movement of the bolt section 66 in the clamping sleeve section 82 of the holding bushing 74 serves however only to adjust the printing table plate 12. In the mounted state, which is represented in FIG. 6, the bolt section 66 is thus rigidly connected to the holding bushing 74 by a clamping ring 76 displaced along an outer surface 78 of the clamping sleeve section 82, where the outer surface has the form of a frustum, and is braced against the outer surface 78 thereby. If the clamping ring 76 is thus drawn downwards by means of two screw bolts 80 in the representation in FIG. 6, the clamping sleeve section 82 narrows and firmly clamps an end of the bolt section 66, specifically the end lying below the circumferential groove 68. For this, the clamping sleeve section 82 is expediently slotted in the transverse direction and provided at its transition to the base body of the holding bushing 74 with an encircling grooving 81 so that a narrowing of the inner diameter of the clamping sleeve section 82 is possible.

In the mounted position represented in FIG. 6, the bolt cross section 66 is thus rigidly connected to the printing table base 14 on one side and rigidly connected to the printing table plate 12 on the other side. However, due to the hinge-like areas at the peripheral grooves 68, 70, the printing table plate 12 can move in the direction perpendicular to the longitudinal direction of the holding bolt 44. The holding bolt 44 can thus apply only holding force in and opposite to its longitudinal direction and thus ensures that the cover plate 62 of the printing table plate 12 remains at a constant distance above the printing table base 14.

In order to make possible an adjustment of the distance between the cover plate 62 of the printing table plate 12 and the printing table base 14, an end of the bolt section 66, specifically the end opposite the printing table plate 12, is provided with an adjustment bushing 84. The adjustment bushing 84 is connected to the end face of the bolt section 66 by way of a screw bolt not represented in FIG. 6 and, when the screw bolts are loosened, can be turned relative to the bolt section 66 about its longitudinal direction. For its part, the adjustment bushing 84 is received in a tapped hole of a holding flange 86, which in turn is connected to the holding bushing 74 by means of screw bolts.

In order, during the adjustment of the printing table plate 12, to move it away from the printing table base 14, the clamping ring 76 is first loosened by loosening the screw bolt 80, so that the bolt section 66 can move in the clamping sleeve section 82 in the direction parallel to its longitudinal direction. Thereupon, the adjustment bushing 84 is screwed further into the tapped hole of the holding flange 86 by a turning motion. The bolt section 66 is displaced correspondingly upward in the direction onto the printing table plate 12. As a consequence of this, the cover plate 62 of the printing table plate 12 also moves upwards in its area above the holding bolt 44 in FIG. 6. Conversely, the cover plate 62 of the printing table plate 12 can be moved downwards by an opposite screw movement of the adjusting bushing 84 relative to the holding flange 86.

If the desired adjustment of the printing table plate 12 is performed, the position of the bolt section 66 can be fixed by securing the screw bolts 80, which, as already mentioned, causes the clamping ring 76 to clamp the lower section of the bolt section 66 in the clamping sleeve section 82.

The perspective view in FIG. 7 shows the printing table base 14 with the cover plate removed. It is to be seen that the printing table base 14 is structured as a ribbed sheet metal part and thus has very great rigidity. In FIG. 7, one can clearly see the openings 34, which are realized by tubular sections inserted in the printing table base 14. Furthermore, it can be seen clearly that starting from the connections 40 or 42, tubular lines for applying a vacuum run within the printing table base 14. Through the ribbed structure of the printing table base 14, it receives very great rigidity but can nevertheless be built up from individual metal sheets in a comparatively simple manner and thus be embodied comparatively easily. The ribbed structure of the printing table base 14 allows the housing of power and control lines.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A printing table for a flatbed printing machine, the printing table comprising:

a printing table base;

a printing table plate disposed on the printing table base and including a point form area which is fixed relative to the printing table base, the point form area being located at a center portion of the printing table plate; and a first set comprising first connecting elements and a second set comprising second connecting elements arranged to connect the printing table base to the printing table plate and to permit movement of the printing table plate relative to the printing table base due to thermal expansion only in a direction substantially parallel to a surface of the printing table plate;

the first connecting elements are arranged to apply a holding force in a first holding direction which prevents displacement of the printing table plate only in a direction substantially perpendicular to the printing table plate surface, and allows displacement of the printing table plate in directions substantially perpendicular to the first holding direction;

a first imaginary line extending from the center portion of the printing table plate in a direction parallel to the printing table surface at an angle selected from 0°, 90°, 180° and 270°;

a second imaginary line extending from the center portion of the printing table plate a direction parallel to the printing table surface at an angle selected from 45°, 135°, 225° and 315°;

each of the second connecting elements of the second set is arranged to apply a holding force in a second holding direction which prevents displacement of the printing table plate only in a direction substantially parallel to the printing table plate surface along a longitudinal axis of said second connecting element, and allows displacement of the printing table plate in directions substantially perpendicular to the second holding direction; wherein a first plurality of said second connecting elements of the second set is disposed such that their respective second holding directions are perpendicular to the first imaginary line; and a second plurality of said second connecting elements of the second set is disposed such that their respective second holding directions are perpendicular to the second imaginary line.

2. The printing table according to claim 1, wherein the second connecting elements are disposed in all four quadrants of the printing table plate.

3. The printing table according to claim 1, wherein the first connecting elements include holding bolts disposed in the direction substantially perpendicular to the printing table surface.

4. The printing table according to claim 2, wherein the first connecting elements include holding bolts disposed in the direction substantially perpendicular to the printing table surface.

5. The printing table according to claim 3, wherein the holding bolts include at least one circumferential groove such that the holding bolts are bendable in an area around the circumferential groove in a direction substantially perpendicular to a longitudinal direction of the holding bolts.

6. The printing table according to claim 4, wherein the holding bolts include at least one circumferential groove such that the holding bolts are bendable in an area around the circumferential groove in a direction substantially perpendicular to a longitudinal direction of the holding bolts.

7. The printing table according to claim 1, wherein the second connecting elements include holding clips arranged to apply holding forces in the direction substantially parallel to the printing table surface and a direction substantially parallel to a longitudinal extending direction of the holding clips, and are bendable in a direction substantially perpendicular to the longitudinal extending direction due to relative movement between the printing table plate and printing table base.

8. The printing table according to claim 2, wherein the second connecting elements include holding clips arranged to apply holding forces in the direction substantially parallel to the printing table surface and a direction substantially parallel to a longitudinal extending direction of the holding clips, and are bendable in a direction substantially perpendicular to the longitudinal extending direction due to relative movement between the printing table plate and printing table base.

9. The printing table according to claim 3, wherein the second connecting elements include holding clips arranged to apply holding forces in the direction substantially parallel to the printing table surface and a direction substantially parallel to a longitudinal extending direction of the holding clips, and are bendable in a direction substantially perpendicular to the longitudinal extending direction due to relative movement between the printing table plate and printing table base.

10. The printing table according to claim 4, wherein the second connecting elements include holding clips arranged to apply holding forces in the direction substantially parallel to the printing table surface and a direction substantially parallel to a longitudinal extending direction of the holding clips, and are bendable in a direction substantially perpendicular to the longitudinal extending direction due to relative movement between the printing table plate and printing table base.

11. The printing table according to claim 5, wherein the second connecting elements include holding clips arranged to apply holding forces in the direction substantially parallel to the printing table surface and a direction substantially parallel to a longitudinal extending direction of the holding clips, and are bendable in a direction substantially perpendicular to the longitudinal extending direction due to relative movement between the printing table plate and printing table base.

12. The printing table according to claim 6, wherein the second connecting elements include holding clips arranged to apply holding forces in the direction substantially parallel to the printing table surface and a direction substantially parallel to a longitudinal extending direction of the holding clips, and are bendable in a direction substantially perpendicular to the longitudinal extending direction due to relative movement between the printing table plate and printing table base.

13. The printing table according to claim 7, wherein the holding clips are defined by cuts in at least one of a cover plate of the printing table base and a cover plate of the printing table plate.

14. The printing table according to claim 8, wherein the holding clips are defined by cuts in at least one of a cover plate of the printing table base and a cover plate of the printing table plate.

15. The printing table according to claim 9, wherein the holding clips are defined by cuts in at least one of a cover plate of the printing table base and a cover plate of the printing table plate.

16. The printing table according to claim 10, wherein the holding clips are defined by cuts in at least one of a cover plate of the printing table base and a cover plate of the printing table plate.

17. The printing table according to claim 11, wherein the holding clips are defined by cuts in at least one of a cover plate of the printing table base and a cover plate of the printing table plate.

18. The printing table according to claim 12, wherein the holding clips are defined by cuts in at least one of a cover plate of the printing table base and a cover plate of the printing table plate.

* * * * *